US008899863B2

(12) United States Patent
Geiger et al.

(10) Patent No.: US 8,899,863 B2
(45) Date of Patent: Dec. 2, 2014

(54) ROLL-ON APPLICATOR DEVICE FOR DISTRIBUTING A VISCOUS MEDIUM ON A SURFACE AND ROLL-ON DISPENSER

(75) Inventors: Andreas Geiger, Steffisburg (CH); Simon Böhlen, Konolfingen (CH)

(73) Assignee: Hoffmann Neopac AG, Thun (CH)

( * ) Notice: Subject to any disclaimer, the term of this patent is extended or adjusted under 35 U.S.C. 154(b) by 349 days.

(21) Appl. No.: 13/381,540

(22) PCT Filed: Jul. 8, 2009

(86) PCT No.: PCT/CH2009/000244

§ 371 (c)(1),
(2), (4) Date: Mar. 22, 2012

(87) PCT Pub. No.: WO2011/003211

PCT Pub. Date: Jan. 13, 2011

(65) Prior Publication Data

US 2012/0177434 A1 Jul. 12, 2012

(51) Int. Cl.

| | |
|---|---|
| ***B43K 7/03*** | (2006.01) |
| ***A45D 40/26*** | (2006.01) |
| *A45D 34/04* | (2006.01) |

(52) U.S. Cl.

CPC ..... *A45D 40/261* (2013.01); *A45D 34/041* (2013.01)

USPC ..... 401/213; 401/209; 401/216

(58) Field of Classification Search

CPC ..... A45D 34/04; A45D 34/041; A45D 40/26; A45D 40/261

USPC ..... 401/209, 213, 215, 216

See application file for complete search history.

(56) References Cited

U.S. PATENT DOCUMENTS

| | | | | |
|---|---|---|---|---|
| 2,700,784 | A * | 2/1955 | De Brock | 401/213 |
| 2,923,957 | A | 2/1960 | Gentile | |
| 4,021,125 | A * | 5/1977 | Berghahn et al. | 401/213 |
| 4,030,844 | A | 6/1977 | Lench et al. | |
| 4,189,066 | A * | 2/1980 | Berghahn | 222/48 |
| 5,213,431 | A * | 5/1993 | Gentile et al. | 401/219 |

FOREIGN PATENT DOCUMENTS

DE 4215966 A1 11/1993

OTHER PUBLICATIONS

International Search Report for PCT/CH2009/000244 dated Mar. 26, 2010.

* cited by examiner

*Primary Examiner* — David Walczak
*Assistant Examiner* — Jennifer C Chiang
(74) *Attorney, Agent, or Firm* — McCormick, Paulding & Huber LLP

(57) ABSTRACT

A roll-on applicator device (11) for distributing a viscous medium on a surface, that has a fitment (14) and a distributor ball (13) placed in the fitment (14) and partially projecting from one end of the fitment, wherein the fitment (14) has a base element (16) and a retaining element (15) that are detachably connected to each other by connection means (25), wherein the base element (16) is provided with support means (21) for supporting the distributor ball (13) and with a tubular member (17) for the connection to a container (12) and wherein the retaining element (15) is designed such that it rotatably retains the distributor ball (13) in the fitment (14). The invention further relates to a roll-on dispenser (10) for dispensing a viscous medium with a container (12) for the viscous medium and such a roll-on applicator device (11).

4 Claims, 3 Drawing Sheets

ROLL-ON APPLICATOR DEVICE FOR DISTRIBUTING A VISCOUS MEDIUM ON A SURFACE AND ROLL-ON DISPENSER

This application claims the priority of PCT Application No. PCT/CH2009/000244, filed on Jul. 8, 2009, the disclosures of which are incorporated herein by reference in their entirety.

TECHNICAL FIELD

The invention relates to a roll-on applicator device for distributing a viscous medium on a surface and to a roll-on dispenser for dispensing a viscous medium.

BACKGROUND

FIG. 1 depicts a perspective view from above of the upper part of a roll-on dispenser 1 according to the state of the art. The roll-on dispenser 1 comprises a roll-on applicator device 2 and a container 3 of which only the upper part is shown that is connected to the roll-on applicator device 2. The known roll-on applicator device 2 comprises a distributor ball 4 and a one-piece fitment 5 with the distributor ball 4 being placed in the fitment 5 and partly projecting from its upper end. The roll-on applicator device 2 is connected to the neck 6 of the container 3, the neck 6 having a thread for screwing a cap (not shown) onto the roll-on applicator device 2 and the neck 6 of the container 3.

The fitment 5 of the known roll-on applicator device 2 is designed as one piece with basically no flexibility in the longitudinal or vertical direction, i.e. the width of the gap between the fitment 5 and the distributor ball 4 is fixed and can basically not be altered to account for different viscosities of the employed viscous media. This non-flexibility may lead to the fitment 5 possibly breaking and the distributor ball 4 being disgorged from the fitment 5 if a correspondingly large amount of pressure is applied to the container 3 of the roll-on dispenser 1.

SUMMARY OF THE INVENTION

It is an object of the invention to provide a roll-on applicator device and a roll-on dispenser by which the above-mentioned drawbacks of the state of the art can be avoided.

In order to implement these and still further objects of the invention, which will become more readily apparent as the description proceeds, a roll-on applicator device for distributing a viscous medium, in particular a viscous fluid, on a surface is provided that comprises a fitment and a distributor ball being placed in the fitment and partially projecting from one of the fitment's ends. The fitment comprises a base element and a retaining element that are detachably connected to each other by connection means. The base element is provided with support means for supporting the distributor ball and with a tubular member for the connection to a container of a roll-on dispenser. The retaining element is designed such that it rotatably retains the distributor ball in the fitment.

The connection means preferably provide clearance for the retaining element in the longitudinal direction, the longitudinal direction being the direction of larger extension of the roll-on dispenser (direction Z in FIGS. 1 and 3). The connection means are furthermore preferentially designed such that the end of the retaining element, from which the distributor ball partially projects, may be slightly tilted or moved outwardly.

The roll-on dispenser for dispensing a viscous medium, in particular a viscous fluid, according to invention comprises a container for the viscous medium and a roll-on applicator device according to the invention, the roll-on applicator device being connected to the container by the tubular member of the base element of the fitment of the roll-on applicator device, with the tubular member being engaged with a neck of the container.

Designing the fitment such that it is formed by two elements, namely the retaining element and the base element that are detachably—and preferably with clearance—connected has the advantage that the fitment is not entirely rigid but flexible. Possible breaking of the fitment and disgorging of the distributor ball can hence be avoided, which might occur with the state-of-the-art roll-on dispenser if too large a pressure is applied to the container, as in such a case the retaining element of the roll-on applicator device according to the invention would slightly move upward in the longitudinal direction/direction of flow of the viscous medium and/or tilt or move outwardly while still retaining the distributor ball.

Furthermore, depending on the viscosity of the applied viscous medium the location of the retaining element of the fitment (which may be altered by its movement in the longitudinal direction and/or outward tilt) and, hence, the width of the gap between the retaining element and the distributor ball are automatically adjusted, i.e. the roll-on applicator device and the roll-on dispenser according to the invention can equally well be used with viscous media of different viscosities.

BRIEF DESCRIPTION OF THE DRAWINGS

Further advantageous features and applications of the invention can be found in the dependent claims as well as in the following description of the drawings illustrating the invention. In the drawings like reference signs designate the same or similar parts throughout the several figures of which:

By "upper part" the part of the roll-on dispenser is meant that comprises the roll-on applicator device. FIG. 1 has already been described in the introductory part and it is herewith referred thereto.

DESCRIPTION OF THE PREFERRED EMBODIMENTS

Figure 1:
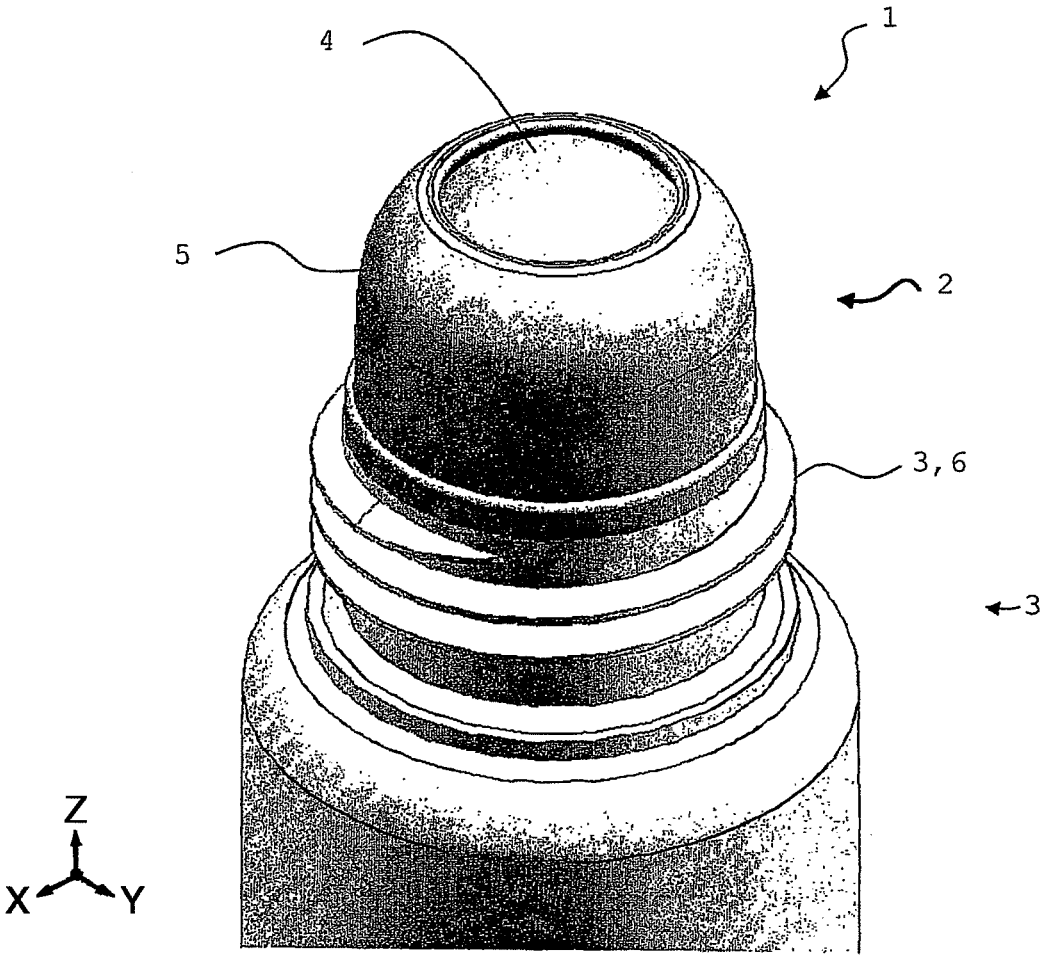
FIG. 1 shows a perspective view from above of the upper part of a roll-on dispenser according to the state of the art.
Figure 2:
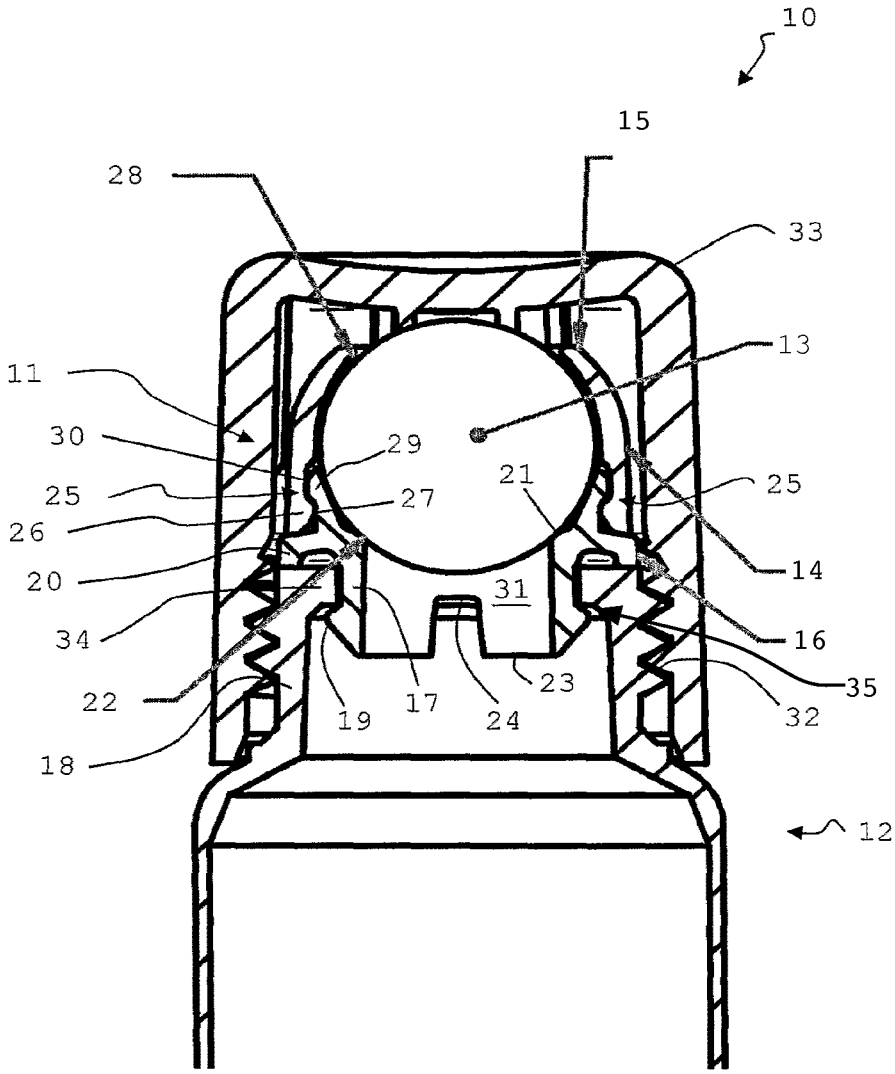
FIG. 2 shows a vertical section of the upper part of a roll-on dispenser according to the invention.
Figure 3:
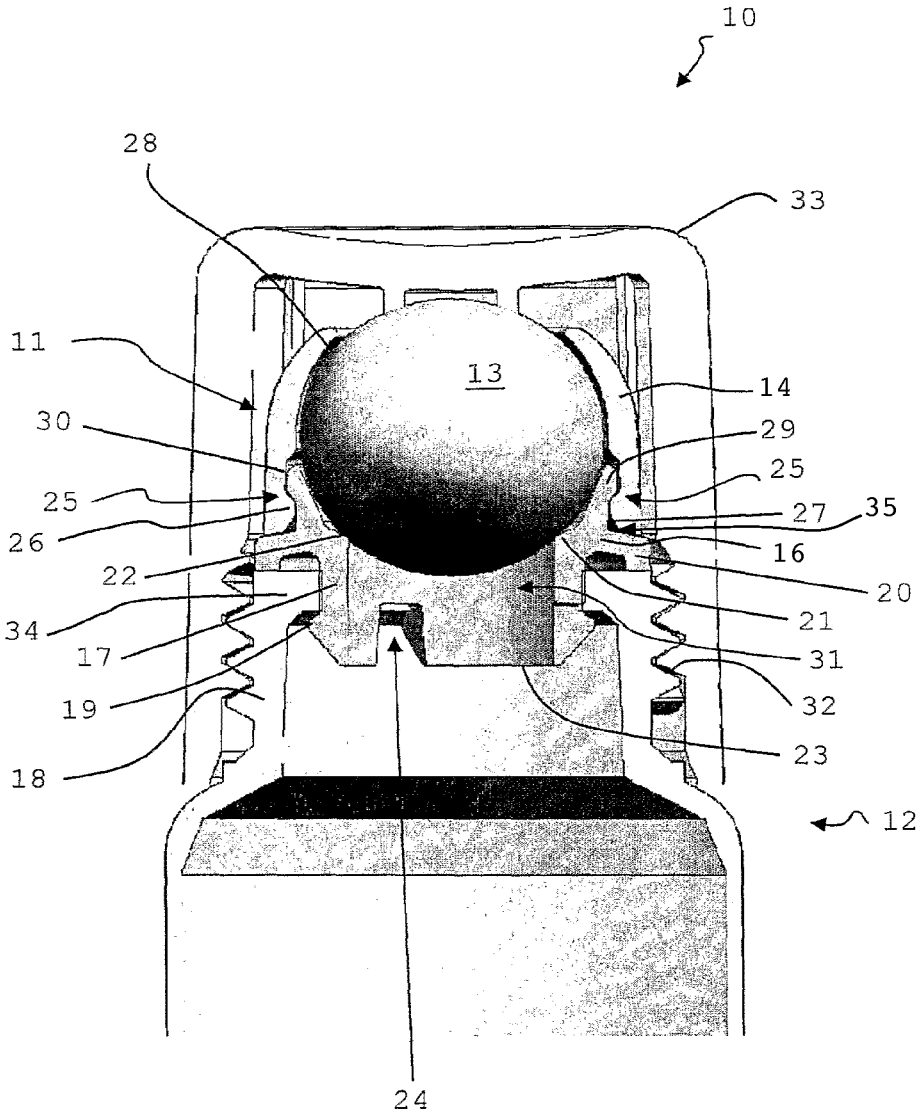
FIG. 3 shows a further vertical section of the upper part of a roll-on dispenser according to the invention.

FIGS. 2 and 3 depict the upper part of a roll-on dispenser 10 according to the invention with a roll-on applicator device 11 according to the invention and the upper part of a container 12 that contains the viscous medium to be dispensed. The roll-on applicator device 11 comprises a distributor ball 13 and a fitment 14. The distributor ball 13 is placed in the fitment 14 and partly projects from that end of the fitment 14 that is distal to the container 12 (also called the distal end of the fitment 14).

The fitment 14 comprises a retaining element 15 and a base element 16 that are detachably connected by connection means 25, the connection means 25 preferably forming part of the retaining element 15 and the base element 16.

The retaining element 15 is designed such that it rotatably retains the distributor ball 13 in the fitment 14. The inside of that portion of the retaining element 15 that does not form part of the connection means 25 and extends to the distal end of the fitment 14 is preferentially at least partly, preferably entirely, curved and shaped a mating surface for/counterpart to the distributor ball 13 to achieve reliable and good retaining of the distributor ball 13 without preventing its rotation.

The base element 16 of the fitment 14 has a tubular member 17, having a diameter smaller than the diameter of the distributor ball 13. The tubular member 17 is suitable for engaging, preferably with moderate forcing, with the neck 18 of the container 12. The end portion of the tubular member 17 that is distal to the retaining element 15 and the distributor ball 13 has an annular outer projection 19 on its outside for engaging with the neck 18 of the container 12. The base element 16 has furthermore a brim 20 of greater diameter than the distributor ball 13, the brim 20 extending in the same direction as the tubular member 17. With the tubular member 17 being forced into the neck 18 of the container 12, an annular inner projection 34 of the neck 18, with the annular inner projection 34 having an inner diameter that is smaller than the outer diameter of the annular outer projection 19, is forced into the space between the annular outer projection 19 and the brim 20 of the base element 16 and then supported by the annular outer projection 19, thereby forming a connection between the roll-on applicator device 11 and the container 12.

The tubular member 17 ends on the inside of the base element 16 with an annular shoulder 21 as support means, whereon the distributor ball 13 rests freely. A gasket 22 may be provided on the annular shoulder 21 for better sealing without preventing rotation of the distributor ball 13. Opposite the annular shoulder 21 the tubular member 17 ends with an annular wall 23 projecting internally, the annular wall 23 defining an opening 24. The annular wall 23 and the internal wall of the tubular member 17 form a chamber 31, wherein the viscous medium accumulates, passing through the opening 24, when pressure is exerted onto the container 12. During use the distributor ball 13 rolls over a surface, in particular a body surface, and a layer of the viscous fluid is deposited on the surface coming from container 12 via the chamber 31 and the gap 28 between the retaining element 15 and the distributor ball 13.

The connection means 25 for connecting the retaining element 15 with the base element 16 of the fitment 14 are preferably designed as snap-on connection means. The snap-on connection means 25 are preferably given by at least one annular indentation 27, 30 and at least one annular bulge 26, 29. Preferentially, a first annular bulge 26 is arranged at the inside of that end portion of the retaining element 15 that is proximal to the base element 16 and a first annular indentation 27 is arranged at the outside of that end portion of the base element 16 that is distal to the annular outer projection 19 such that when engaging the first annular bulge 26 with the first annular indentation 27 the retaining element 15 and the base element 16 are tightly connected. Of course, the first annular bulge 26 may also be arranged at the outside of the base element 16 and the first annular indentation 27 may also be arranged at the inside of the retaining element 15 at said positions.

The longitudinal extension of the first indentation 27 is preferably greater than the longitudinal extension of the first annular bulge 26 to provide for clearance 35 for the retaining element 15 from the base element 16 in the longitudinal direction, such that the position of the retaining element 15 is of variable height and accordingly the width of the gap 28 between the retaining element 15 and the distributor ball 13 is variable.

It is preferred that a second annular bulge 29 and a second annular indentation 30 are provided. The second annular bulge 29 is preferably arranged at the outside of that end portion of the base element 16 that is proximal to the retaining element 15, wherein the second annular bulge 29 is preferably arranged next to the first indentation 27 and closer to the distal end of the fitment 14 than the first annular indentation 27. The second annular indentation 30 is preferably arranged at the inside of the end portion of the retaining element 15 that is proximal to the base element 16, wherein the second annular indentation 30 is preferably arranged next to the first annular bulge 26 and closer to the distal end of the fitment 14 than the first annular bulge 26.

When engaging the first annular bulge 26 with the first annular indentation 27 then also the second annular bulge 29 engages with the second annular indentation 30 leading to the retaining element 15 and the base element 16 being even more tightly connected. If the annular bulge 26 is arranged at the outside of the base element 16 and the first annular indentation 27 is arranged at the inside of the retaining element 15 as indicated above as alternative arrangement then correspondingly the second annular bulge 29 is arranged at the inside of the retaining element 15 and the second annular indentation 30 is arranged at the outside of the base element 16 at said positions.

As with the first annular indentation 27 and the first annular bulge 26, the longitudinal extension of the second annular indentation 30 is preferentially greater than the longitudinal extension of the second annular bulge 29 for the same reasons as given above for the longitudinal extension of the first annular indentation 27 with respect to the first annular bulge 26.

That the fitment 14 is given by the retaining element 15 and by the base element 16 that are detachably and preferably with clearance 35 in the longitudinal; direction, connected has the effect that the location of the retaining element 15 is variably with respect to height and distance to the distributor ball 13, i.e. the location of the retaining element 15 is flexible in the longitudinal direction and can adjust to and vary in particular with the viscosity of the employed viscous medium, thereby widening or narrowing the gap 28 between the retaining element 15 and the distributor ball 13 if appropriate. Furthermore, if large pressures are exerted onto the container 12 with the viscous medium and hence via the chamber 31 onto the distributor ball 13, disgorging of the distributor ball 13 from the roll-on applicator device 11 can be avoided, as the retaining element 15 automatically adjusts its location, in particular its height, appropriately, while still retaining the distributor ball 13.

The outside of the neck 18 of the container 12 has preferably a thread 32 onto which a cap 33 with a corresponding thread on its inside can be screwed, the cap 33 being placed over the roll-on applicator device 11. Advantageously, the roll-on applicator device 11 according to the invention may be used with any conventional type of container 12.

It is to be understood that while certain embodiments of the present invention have been illustrated and described herein, it is not to be limited to the specific embodiments described and shown.

The invention claimed is:

1. A roll-on applicator device for distributing a viscous medium on a surface, comprising a fitment (14) and a distributor ball (13) being placed in the fitment (14) and partially projecting from an end of the fitment, characterized in that the fitment (14) comprises a base element (16) and a retaining element (15) that are detachably connected to each other by snap-on connection means (25) that are given by at least one annular indentation (27, 30) and by at least one annular bulge (26, 29), wherein the base element (16) is provided with support means (21) for supporting the distributor ball (13) and with a tubular member (17) for the connection to a container (12), wherein the retaining element (15) rotatably retains the distributor ball (13) in the fitment (14), wherein a first annular bulge (26) is arranged at the inside of an end portion of the retaining element (15) that is proximal to the base element (16) and wherein a first annular indentation (27) is arranged at the outside of the base element (16) such that for connecting the retaining element (15) with the base element (16) the first annular bulge (26) engages with the first annular indentation (27).

2. The roll-on applicator device according to claim 1, wherein the longitudinal extension of the first annular indentation (27) is greater than the longitudinal extension of the first annular bulge (26).

3. The roll-on applicator device according to claim 1, wherein a second annular bulge (29) is arranged at the outside of an end portion of the base element (16) that is proximal to the retaining element (15) and wherein a second annular indentation (30) is arranged at the inside of the retaining element (15) such that for connecting the retaining element (15) with the base element (16) the second annular bulge (29) engages with the second annular indentation (30).

4. roll-on applicator device according to claim 3, wherein the longitudinal extension of the second annular indentation (30) is greater than the longitudinal extension of the second annular bulge (29).

* * * * *